US008290185B2

(12) United States Patent
Kim

(10) Patent No.: US 8,290,185 B2
(45) Date of Patent: Oct. 16, 2012

(54) METHOD OF COMPENSATING FOR AUDIO FREQUENCY CHARACTERISTICS AND AUDIO/VIDEO APPARATUS USING THE METHOD

(75) Inventor: Jong-bae Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1076 days.

(21) Appl. No.: 12/181,537

(22) Filed: Jul. 29, 2008

(65) Prior Publication Data

US 2009/0196428 A1 Aug. 6, 2009

(30) Foreign Application Priority Data

Jan. 31, 2008 (KR) ..... 10-2008-0010318

(51) Int. Cl.
*H04R 5/02* (2006.01)

(52) U.S. Cl. ..... 381/300; 381/104; 381/105; 381/106; 381/107; 381/108; 381/109; 381/56; 381/57; 381/311; 381/98; 961/17; 961/77; 961/204; 348/14.08; 348/739; 348/158; 700/94

(58) Field of Classification Search ..... 381/182, 381/186, 310, 17, 103, 98, 24; 348/14.08, 348/739, 158; 700/94
See application file for complete search history.

(56) References Cited

U.S. PATENT DOCUMENTS

| | | | | |
|---|---|---|---|---|
| 4,823,391 | A * | 4/1989 | Schwartz | 381/103 |
| 4,926,487 | A * | 5/1990 | Yoshida et al. | 381/186 |
| 2006/0062410 | A1 * | 3/2006 | Kim et al. | 381/310 |

* cited by examiner

*Primary Examiner* — Steven Loke
*Assistant Examiner* — Cuong Nguyen
(74) *Attorney, Agent, or Firm* — Stanzione & Kim, LLP

(57) ABSTRACT

A method of compensating for spatial audio frequency characteristics that varies in accordance with a mounting condition of a down firing speaker of an audio/video (AV) apparatus includes calculating a listening distance between the AV apparatus and a listener, calculating a distance between a speaker mounted on the AV apparatus and a neighboring reflective surface, setting a spatial frequency compensation filter value and a speaker frequency characteristic compensation filter value based on the calculated distances, and compensating for frequency characteristics of an audio signal by combining the spatial frequency compensation filter value and the speaker frequency characteristic compensation filter value.

20 Claims, 9 Drawing Sheets

METHOD OF COMPENSATING FOR AUDIO FREQUENCY CHARACTERISTICS AND AUDIO/VIDEO APPARATUS USING THE METHOD

CROSS-REFERENCE TO RELATED APPLICATIONS

This application claims priority under 35 U.S.C. §119(a) from Korean Patent Application No. 10-2008-0010318, filed on Jan. 31, 2008, in the Korean Intellectual Property Office, the disclosure of which is incorporated herein in its entirety by reference.

BACKGROUND OF THE INVENTION

1. Field of the Invention

The present general inventive concept relates to an audio/video (AV) system including a hidden speaker, and more particularly, to a method of compensating for spatial audio frequency characteristics which vary in accordance with a mounting condition of a down firing speaker of an AV apparatus, and an AV apparatus using the method.

2. Description of the Related Art

Recently, a hidden speaker used in a thin television (TV) has become popular. In the hidden speaker, a speaker is hidden behind a bezel, and sound is transferred forward passing through a waveguide.

However, the waveguide is a type of acoustic band pass filter, and emphasizes sound pressure of a middle band and reduces the sound pressure of a high band. In particular, a peak component exists in a frequency of approximately 10 kilohertz (kHz) and thus the waveguide does not have proper frequency characteristics for equalizing. A frequency of the peak component is dependent upon a shape of the waveguide.

Accordingly, a method of improving sound quality without using a waveguide is required.

SUMMARY OF THE INVENTION

The present general inventive concept provides a method of automatically compensating for frequency variations in accordance with a mounting condition of a down firing speaker of an audio/video (AV) apparatus.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a method of compensating for audio frequency characteristics of an audio/video (AV) apparatus, the method including calculating a listening distance between the AV apparatus and a listener, calculating a distance between a speaker mounted on the AV apparatus and a neighboring reflective surface, setting a spatial frequency compensation filter value and a speaker frequency characteristic compensation filter value based on the calculated distances, and compensating for frequency characteristics of an audio signal by combining the spatial frequency compensation filter value and the speaker frequency characteristic compensation filter value.

The foregoing and/or other aspects and utilities of the general inventive concept may also be achieved by providing an audio/video (AV) apparatus including channel speaker units to output audio signals, a control unit to extract information on a listening distance between the AV apparatus and a listener, and information on a distance between each of the channel speaker units and a respective neighboring reflective surface thereof, and to set a spatial frequency compensation filter and a speaker frequency characteristic compensation filter of each of the channel speaker units, based on the extracted information, and an audio frequency compensation unit to compensate for frequency characteristics of an audio signal by combining the spatial frequency compensation filter and the speaker frequency characteristic compensation filter which are set by the control unit.

The foregoing and/or other aspects and utilities of the general inventive concept may also be achieved by providing an audio/video (AV) apparatus including a channel speaker unit including one or more of a spatial frequency compensation filter and a speaker frequency characteristic compensation filter, and disposed at a predetermined angle off-axis position from a listener, and a control unit to extract information on at least one of a listening distance between the AV apparatus and the listener, and a surface distance between the channel speaker unit and a neighboring reflective surface thereof, wherein the control unit sets, based on the extracted information, the one or more of the spatial frequency compensation filter to compensate for frequency characteristics which vary in accordance with a mounting condition of the channel speaker unit and a speaker frequency characteristic compensation filter to compensate for a high band based on the extracted information.

The predetermined angle may be substantially 90 degrees.

The channel speaker unit may be disposed at a predetermined angle off-axis position from a listener to prevent the listener from viewing the channel speaker unit from a front side of the AV apparatus.

The foregoing and/or other aspects and utilities of the general inventive concept may also be achieved by providing a method of operating an audio/video (AV) apparatus, the method including extracting information on at least one of a listening distance between an AV apparatus and a listener, and a surface distance between a channel speaker unit disposed at a predetermined angle off-axis position from the listener and a neighboring reflective surface thereof, and setting, based on the extracted information, one or more of a spatial frequency compensation filter to compensate for frequency characteristics which vary in accordance with a mounting condition of the channel speaker unit and a speaker frequency characteristic compensation filter to compensate for a high band based on the extracted information.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
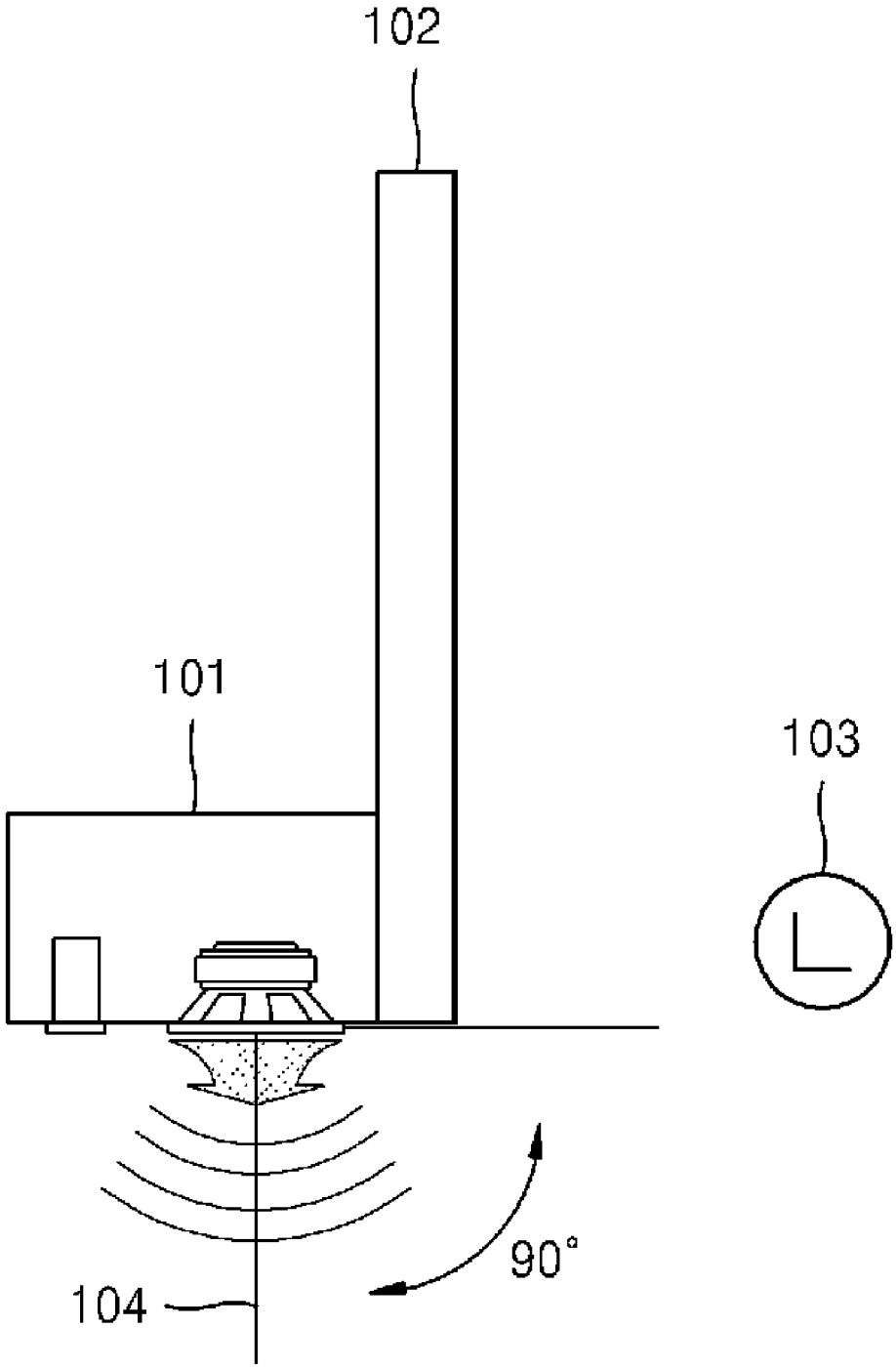
FIG. 1 is a diagram illustrating a listening position when a speaker having a down firing structure included in an audio/video (AV) apparatus is down-fired.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

In various embodiments of the present general inventive concept, a down firing speaker unit is used as a hidden speaker.

FIG. 1 is a diagram illustrating a listening position when a speaker having a down firing structure included in an audio/video (AV) apparatus is down-fired.

In the down firing structure, the speaker 101 is mounted on a lower portion of the AV apparatus and a diaphragm of the speaker 101 faces downward. The AV apparatus, for example, includes a television panel 102.

The speaker 101 is mounted on the AV apparatus or a wall mount speaker apparatus, and is disposed at a predetermined angle off-axis position from a listener (L) 103 so as not to be seen from a front side of the AV apparatus.

However, in the down firing structure, the listener 103 is placed at a 90° off-axis position from an axis 104 of the speaker 101, a sound pressure of a high band is reduced, and frequency characteristics greatly vary in accordance with a mounting condition such as a distance from the speaker 101 to a wall and the distance from the speaker 101 to a floor, in comparison to a front firing structure.

The speaker 101 is divided into a wall mount type that is fixed on the wall and a stand mount type that is not fixed on the wall.

In order to measure the frequency characteristics, a microphone corresponding to the listener 103 is disposed at the 90° off-axis position from the axis 104 of the speaker 101 from which an audio signal is output.

Figure 2:
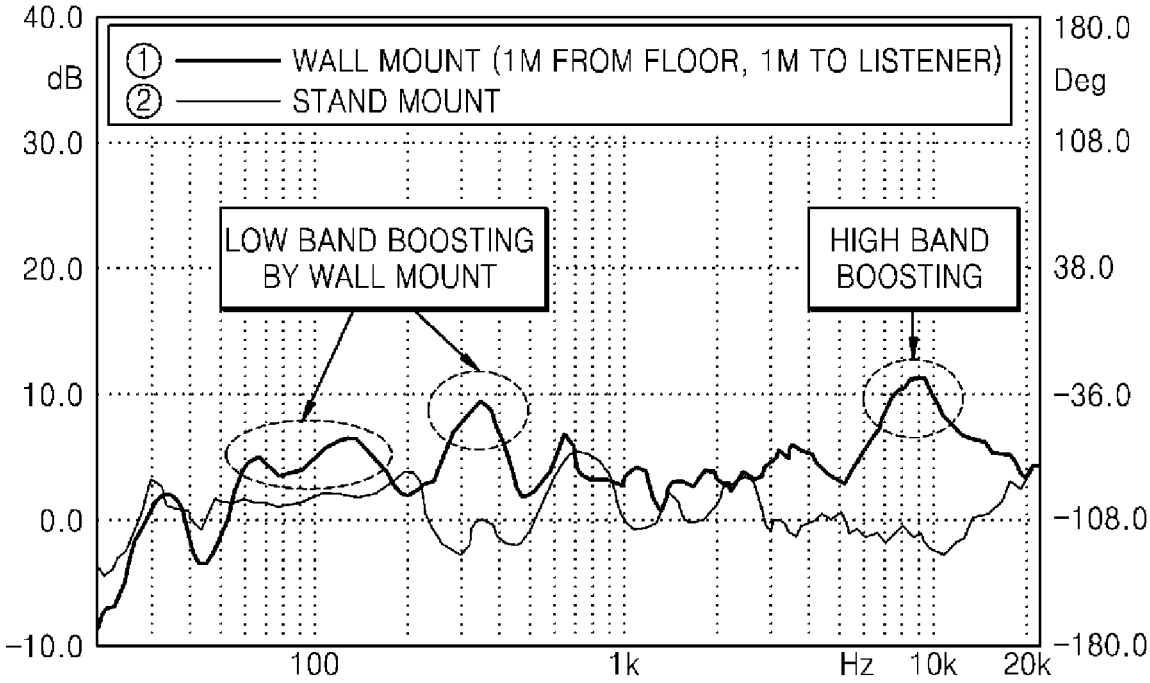
FIG. 2 is a graph illustrating relative frequency variations in accordance with a listening space in comparison to anechoic room tuning frequency characteristics.

FIG. 2 is a graph illustrating relative frequency variations in accordance with a listening space in comparison to anechoic room tuning frequency characteristics.

In FIG. 2, curve ① represents frequency characteristics of a wall mount down firing speaker when a distance from a speaker to a floor is 1 meter (m) and the distance from the speaker to a listener is also 1 m, and curve ② represents the frequency characteristics of a stand mount down firing speaker. In the wall mount down firing speaker, sound directly output from the speaker and the sound reflected from the floor are combined and thus a boosting effect of the sound occurs in low and high bands. However, variations of the frequency characteristics of the stand mount down firing speaker are not great. Accordingly, the boosting effect of a certain band and frequency distortion caused by a damping effect in the wall mount down firing speaker are greater than the boosting effect and the frequency distortion in the stand mount down firing speaker.

Figure 3:
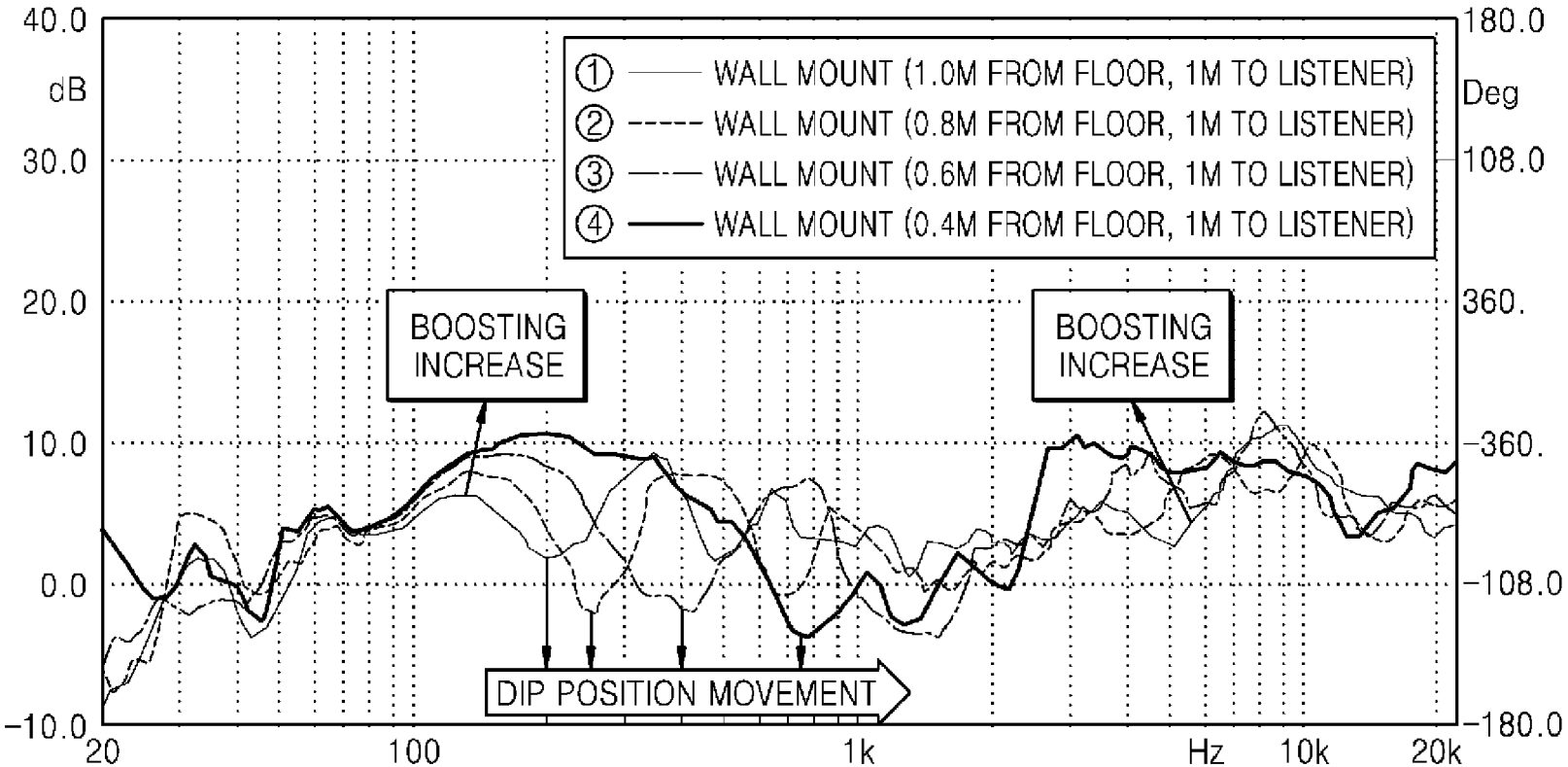
FIG. 3 is a graph illustrating frequency characteristic variations in accordance with a mounting condition of a down firing speaker unit, according to an embodiment of the present general inventive concept.

FIG. 3 is a graph illustrating frequency characteristic variations in accordance with a mounting condition of a down firing speaker unit, according to an embodiment of the present general inventive concept.

If a down firing speaker is a wall mount type, boosting and damping variations of frequency characteristics occur in accordance with a distance from a speaker to a floor and the distance from the speaker to a listener.

Referring to FIG. 3, different boosting and damping variations of the frequency characteristics occur if the mounting condition of the down firing speaker unit is set as described below:

① when the distance from the speaker to the floor is 1 m, and the distance from the speaker to the listener is 1 m;

② when the distance from the speaker to the floor is 0.8 m, and the distance from the speaker to the listener is 1 m;

③ when the distance from the speaker to the floor is 0.6 m, and the distance from the speaker to the listener is 1 m; and ④ when the distance from the speaker to the floor is 0.4 m, and the distance from the speaker to the listener is 1 m.

For example, if the distance from the speaker to the floor is 0.4 m, a boosting effect of 10 decibel (dB) occurs in a band of 100 hertz (Hz)-500 Hz, and the boosting effect also occurs in a band of 2.5 kilohertz (kHz). Also, a position of a dip component varies in accordance with distance variations between the speaker and the floor.

The boosting effect of a certain band in accordance with the distance variations between the speaker and the floor occurs when a low band boosting effect and a comb filter effect simultaneously occur. The low band boosting effect occurs in accordance with the number of neighboring walls, and the comb filter effect occurs when sound directly output from the speaker and the sound reflected from the floor are linearly combined.

Figure 4:
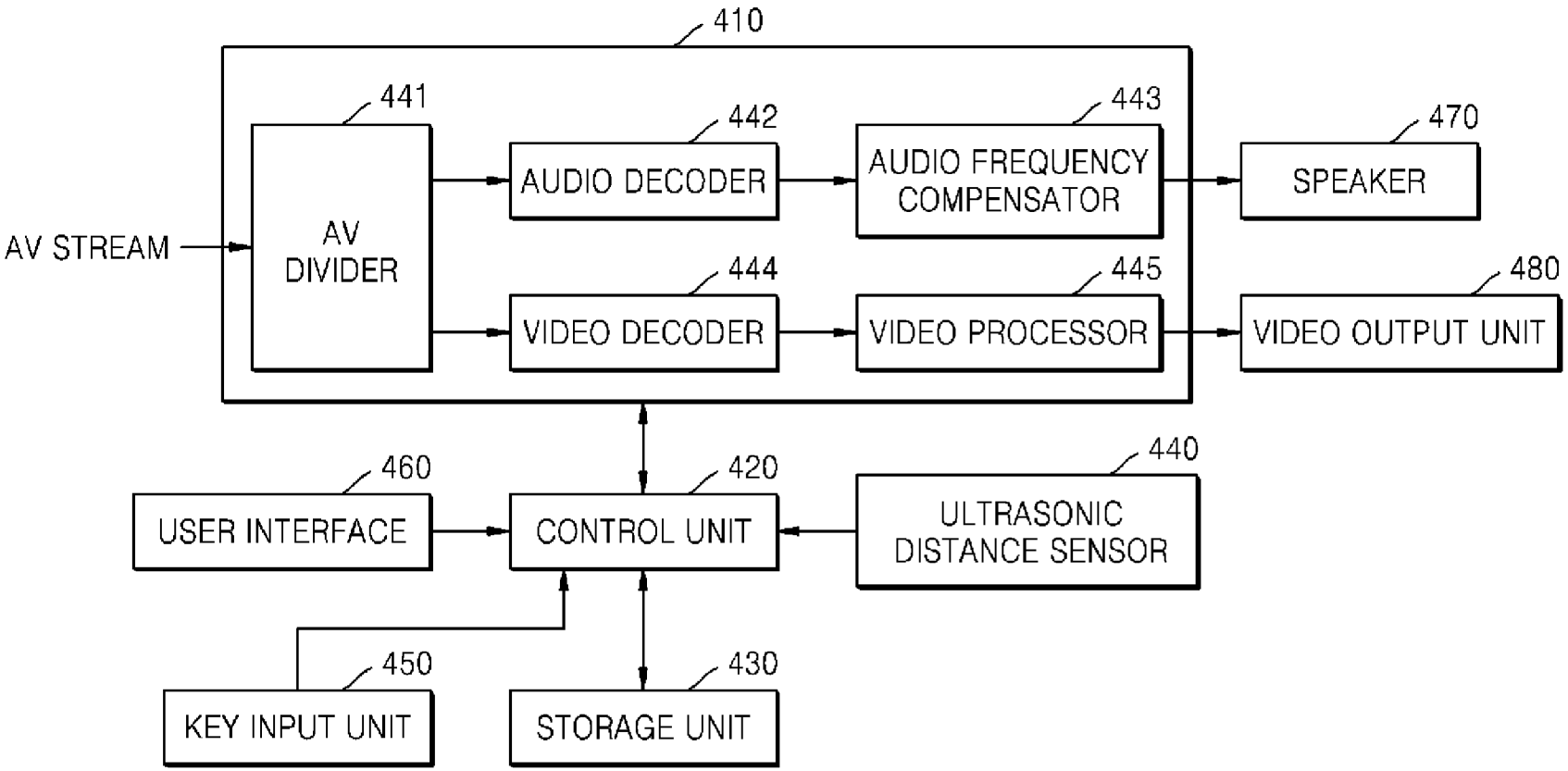
FIG. 4 is a block diagram illustrating an AV apparatus according to an embodiment of the present general inventive concept.

FIG. 4 is a block diagram illustrating an AV apparatus according to an embodiment of the present general inventive concept.

Referring to FIG. 4, the AV apparatus according to the current embodiment of the present general inventive concept includes an AV signal processor 410, a control unit 420, a storage unit 430, an ultrasonic distance sensor 440, a key input unit 450, a user interface (UI) 460, a speaker 470, and a video output unit 480.

Initially, an AV stream stored in a recording medium such as a digital versatile disc (DVD) or flash random access memory (ROM), a broadcasting stream received through a wire or wirelessly, or a video stream input from an external device, is input into the AV apparatus.

The AV signal processor 410 processes the AV stream that is input in accordance with a control signal output from the control unit 420. The AV signal processor 410 includes an AV divider 441, an audio decoder 442, an audio frequency compensator 443, a video decoder 444, and a video processor 445.

The AV divider 441 divides the AV stream into an audio stream and a video stream.

The audio decoder 442 decodes the audio stream output from the AV divider 441 into an audio signal by using a predetermined audio restoration algorithm.

The audio frequency compensator 443 compensates for frequency characteristics of the audio signal by combining a spatial frequency compensation filter and a speaker frequency characteristic compensation filter which are set by the control unit 420.

The video decoder 444 decodes the video stream output from the AV divider 441 into a video signal by using a predetermined video restoration algorithm.

The video processor 445 converts the video signal decoded by the video decoder 444 into a video signal having a format that can be output to a display unit (not illustrated).

The speaker 470 outputs the audio signal having the compensated frequency characteristics by the audio frequency compensator 443.

The video output unit 480 outputs the video signal processed by the video processor 445 to the display unit or to an external display device through an external output terminal.

The ultrasonic distance sensor 440 is disposed on a lower portion of a front surface of the AV apparatus so as to correspond to a position of the speaker 470, generates ultrasonic waves, and senses reflected ultrasonic waves.

The key input unit 450 may be, for example, a key pad or a touch screen, and may include a plurality of number/text keys to select various operations, and functional keys to interface with a user.

The UI 460 provides an interface to exchange information between the AV apparatus and the user. In particular, the UI 460 inputs a distance between the speaker 470 and a neighboring reflective surface and the distance between the AV apparatus and a listener, which are defined by the user, to the AV apparatus.

The storage unit 430 includes, for example, ROM to store a plurality of programs and data, and voice memory. In particular, the storage unit 430 stores a frequency characteristic compensation filter of a down firing speaker having a factory default setting, and the spatial frequency compensation filter previously set in accordance with the distance between the speaker 470 and the neighboring reflective surface, in a form of a look-up table. For example, the storage unit 430 stores spatial frequency compensation filter values which are inversely calculated from the frequency characteristic variations in accordance with a mounting condition of a down firing speaker unit, which are illustrated in FIG. 3.

The control unit 420 extracts information on a listening distance between the AV apparatus and the listener and information on a distance between each channel speaker unit and a neighboring reflective surface by using the ultrasonic waves generated by the ultrasonic distance sensor 440, selects a spatial frequency compensation filter value and a speaker frequency characteristic compensation filter value of each channel, which are stored in the storage unit 430, based on the extracted distance information, and applies the spatial frequency compensation filter value and the speaker frequency characteristic compensation filter value to the audio frequency compensator 443. In this case, the distances may be measured by using various methods. For example, the control unit 420 measures the distance between each channel speaker unit and the neighboring reflective surface by calculating a period of time from when the ultrasonic distance sensor 440 generates the ultrasonic waves until when the ultrasonic waves are reflected to the ultrasonic distance sensor 440, in consideration of speed of the ultrasonic waves. Also, the control unit 420 measures the listening distance between the AV apparatus and the listener by using the ultrasonic waves of a remote controller which are sensed by the ultrasonic distance sensor 440.

According to another example of the present general inventive concept, the control unit 420 may measure the distances between the speaker 470 and a floor and between the AV apparatus and the listener by using distance information which is defined and input by the user through the UI 460.

Figure 5A:
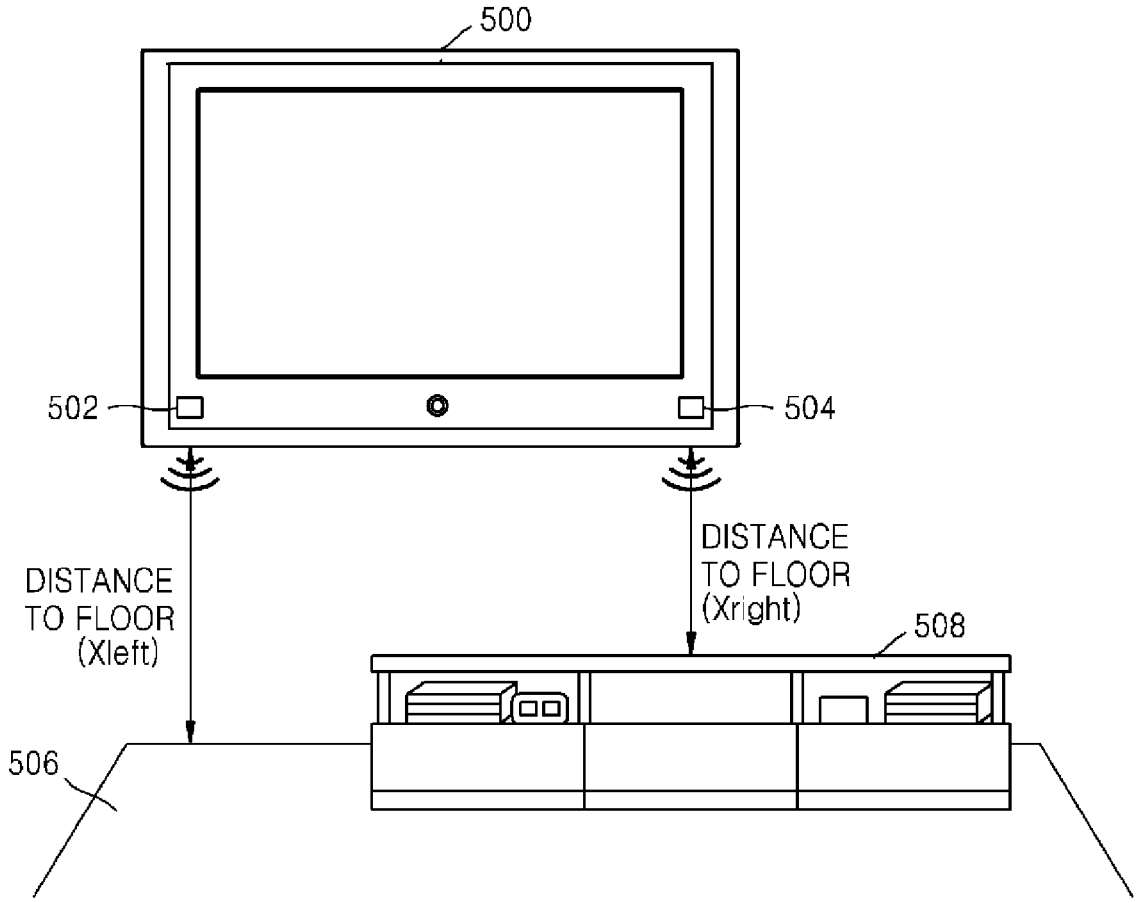
FIG. 5A is an outside view illustrating an AV apparatus according to an embodiment of the present general inventive concept.

FIG. 5A is an outside view illustrating an AV apparatus 500 according to an embodiment of the present general inventive concept.

Referring to FIG. 5A, left and right channel speakers having a down firing structure are mounted on lower portions of the AV apparatus 500.

Ultrasonic distance sensors 502 and 504 are mounted at positions corresponding to the left and right channel speakers. Thus, the ultrasonic distance sensors 502 and 504 respectively measures a distance Xleft from a left channel speaker to a floor 506 and a distance Xright from a right channel speaker to a floor 508.

Figure 5B:
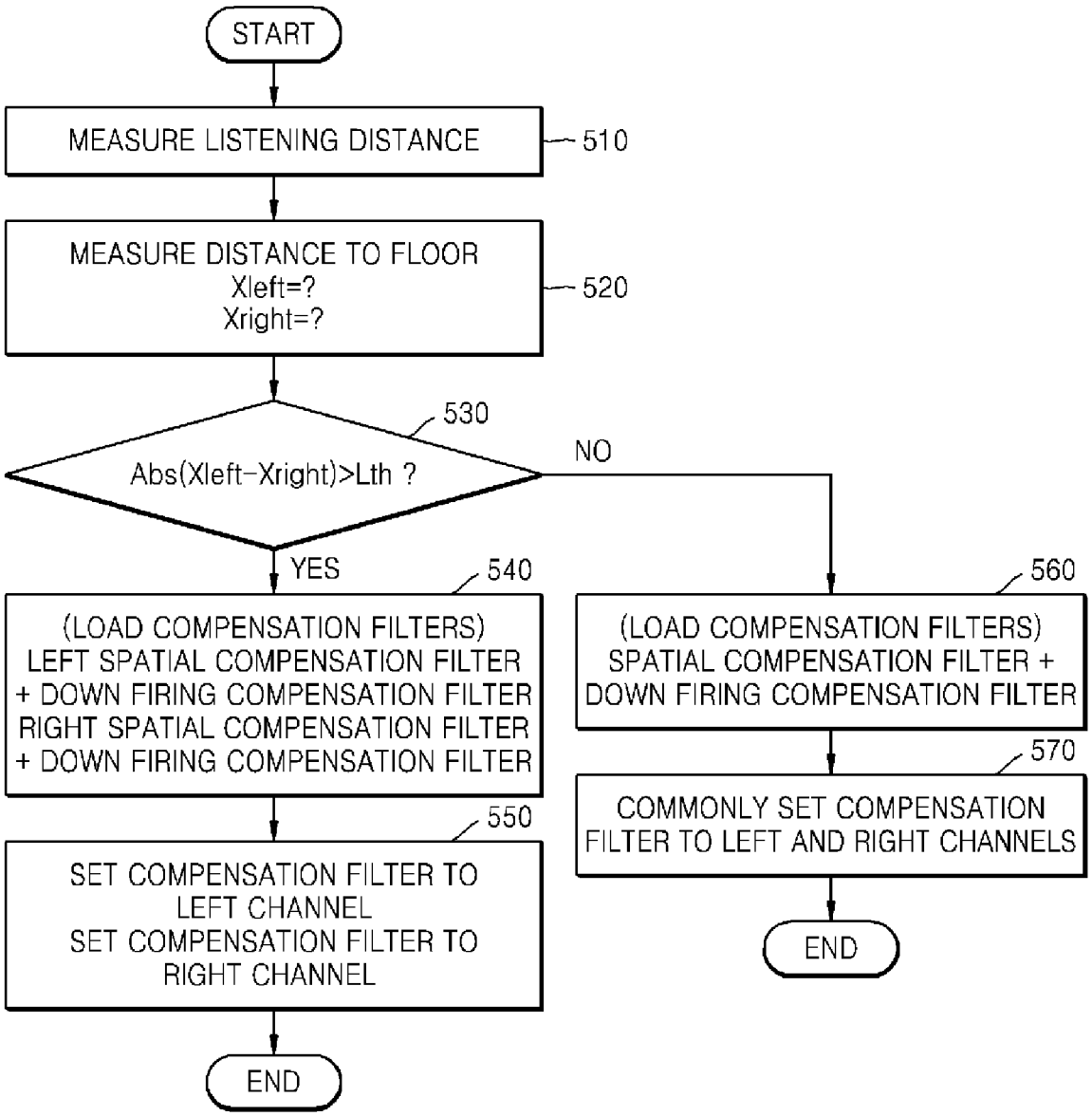
FIG. 5B is a flowchart illustrating a method of compensating for audio frequency characteristics of an AV apparatus, according to an embodiment of the present general inventive concept.

FIG. 5B is a flowchart illustrating a method of compensating for audio frequency characteristics of an AV apparatus, according to an embodiment of the present general inventive concept.

Referring to FIG. 5B, a listening distance between the AV apparatus and a listener is calculated by using an ultrasonic distance sensor, in operation 510. For example, if the AV apparatus is turned on, the ultrasonic distance sensor may generate ultrasonic waves and measure a distance between a speaker and a neighboring reflective surface by receiving the ultrasonic waves which hit a measuring subject (floor or wall) and are reflected back to the ultrasonic distance sensor. Also, the ultrasonic distance sensor may measure the listening distance between the AV apparatus and the listener by using the ultrasonic waves which are received from a remote controller.

The listening distance between the AV apparatus and the listener may also be measured by using various methods such as a method of detecting an iris, and a source localization method using voice.

Then, a distance Xleft from a left channel speaker to a neighboring reflective surface thereof (floor or wall) and a distance Xright from a right channel speaker to a neighboring reflective surface thereof (floor or wall) are respectively calculated by using left and right ultrasonic distance sensors which are respectively mounted at positions corresponding to left and right channel speakers, in operation 520.

Then, a difference between the distances Xleft and Xright is calculated and the difference is compared to a preset threshold value, in operation 530.

If the difference is larger than the threshold value, a spatial frequency compensation filter value and a down firing frequency characteristic compensation filter value of each down firing channel, which correspond to the distances Xleft and Xright are read from ROM, in operation 540. For example, if the distance Xleft is 1 m, the distance Xright is 0.5 m, and the listening distance is 1 m, compensation filter values corresponding to the respective distances are loaded from spatial frequency compensation filter values and down firing frequency characteristic compensation filter values which are previously stored in the ROM in accordance with distances.

In this case, the down firing frequency characteristic compensation filter values which compensate for frequency characteristics of high band signals and the spatial frequency compensation filter values which compensate for the frequency characteristics varying in accordance with a mounting space are previously stored in the ROM. Here, the down firing frequency characteristic compensation filter values are set in default by a manufacturer and compensate for sound pressure reduction of high bands. The spatial frequency compensation filter values are stored as filter coefficients which are set by predetermined distance intervals and compensate for the frequency characteristics which are boosted or damped by being reflected off the floor or wall. In this case, the spatial frequency compensation filter values are obtained by inversely calculating the frequency characteristic variations in accordance with a mounting condition of a down firing speaker unit, which are illustrated in FIG. 3.

A down firing frequency characteristic compensation filter and a spatial frequency compensation filter use a form of a finite impulse response (FIR) filter or an infinite impulse response (IIR) filter.

Then, the down firing frequency characteristic compensation filter value and the spatial frequency compensation filter value are separately set to audio signals of the left and right channel speakers so as to separately compensate for the frequency characteristics of the audio signals, in operation 550.

Alternatively, if the difference is equal to or smaller than the threshold value, the spatial frequency compensation filter value and the down firing frequency characteristic compensation filter value which correspond to the distances Xleft and Xright are read from the ROM, in operation 560.

Then, the spatial frequency compensation filter value and the down firing frequency characteristic compensation filter value are commonly set to the audio signals of the left and right channel speakers so as to compensate for the frequency characteristics of the audio signals, in operation 570.

Thus, the spatial frequency compensation filter value and the down firing frequency characteristic compensation filter value determine an audio frequency compensation characteristic of the AV apparatus, which is optimized to the distances Xleft and Xright between the left and right channel speakers and their neighboring floors thereof.

Figure 5C:
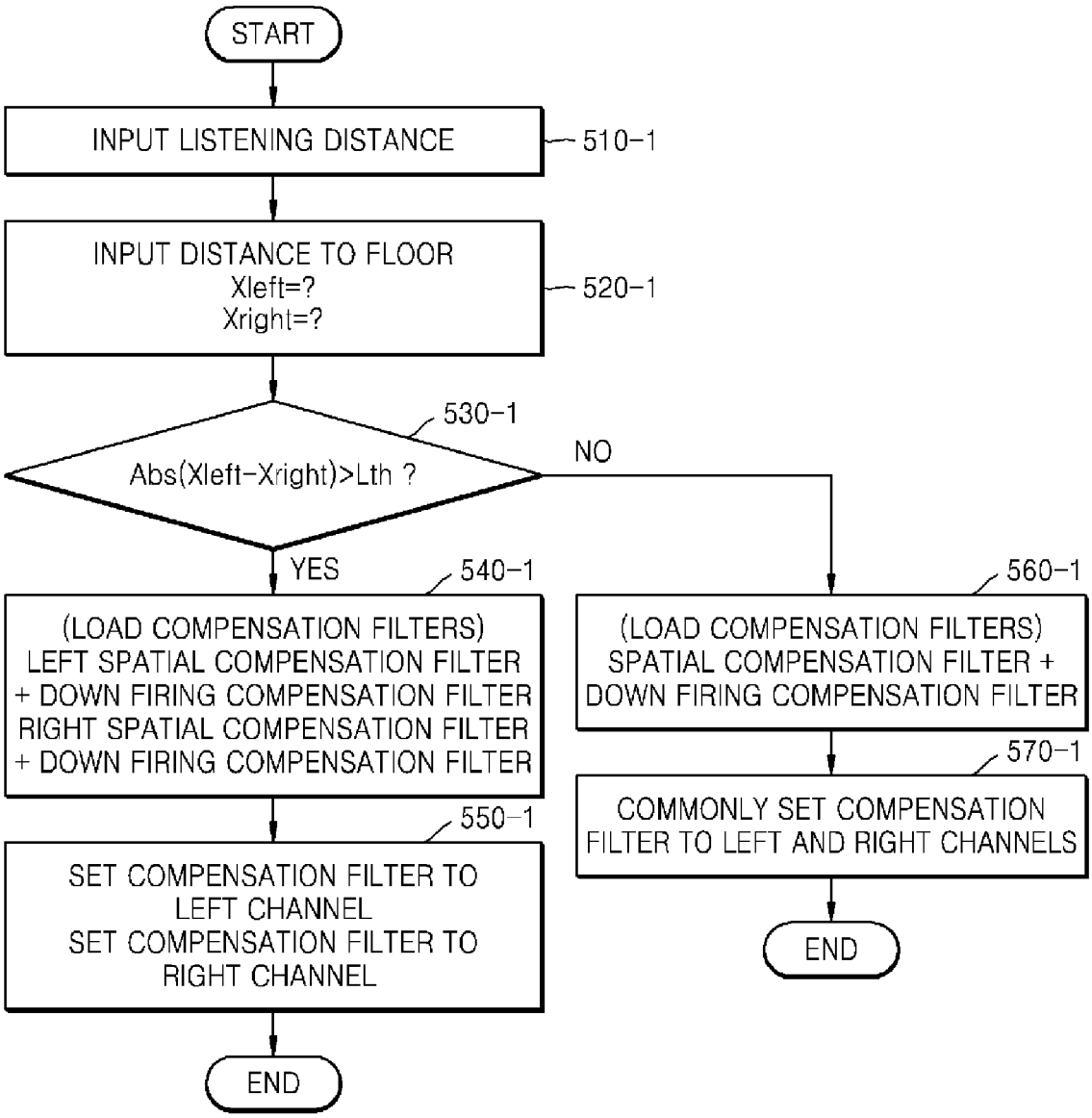
FIG. 5C is a flowchart illustrating a method of compensating for audio frequency characteristics of an AV apparatus, according to another embodiment of the present general inventive concept.

FIG. 5C is a flowchart illustrating a method of compensating for audio frequency characteristics of an AV apparatus, according to another embodiment of the present general inventive concept.

Referring to FIG. 5C, a user inputs a listening distance between the AV apparatus and a listening position by using a UI, in operation 510-1.

Then, the user inputs a distance Xleft from a left channel speaker to a left floor and a distance Xright from a right channel speaker to a right floor, in operation 520-1.

Then, frequency characteristics of audio signals are compensated for by using the distances which are input by the user, in operations 530-1, 540-1, 550-1, 560-1, and 570-1. Operations 530-1, 540-1, 550-1, 560-1, and 570-1 respectively correspond to operations 530, 540, 550, 560, and 570 illustrated in FIG. 5B and thus detailed descriptions thereof will be omitted here.

Figure 6A:
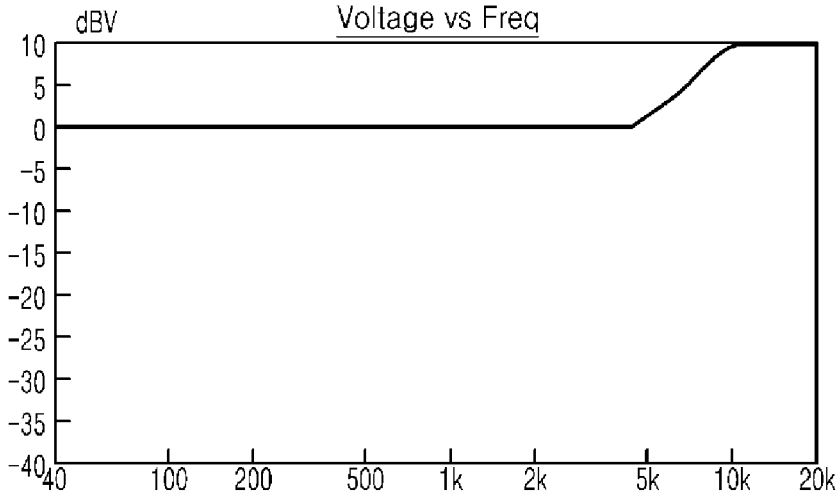
FIGS. 6A through 6C are graphs illustrating compensation filters to compensate for audio frequency characteristics, according to an embodiment of the present general inventive concept.
Figure 6B:
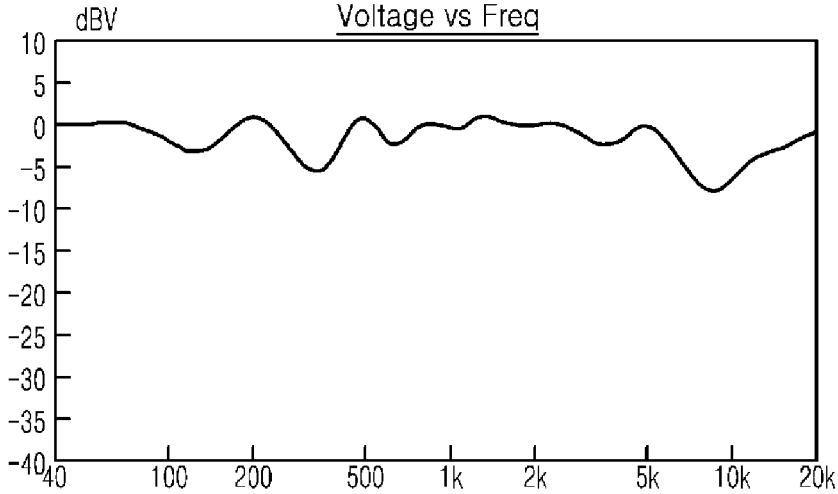
Figure 6C:
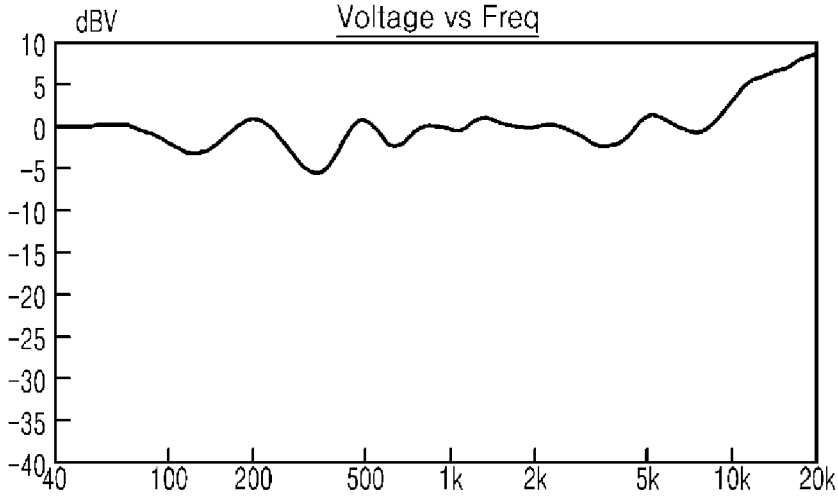

FIGS. 6A through 6C are graphs of compensation filters to compensate for audio frequency characteristics, according to an embodiment of the present general inventive concept.

FIG. 6A illustrates frequency characteristics of a down firing frequency characteristic compensation filter to compensate for the frequency characteristics of a high band signal.

FIG. 6B illustrates frequency characteristics of a spatial frequency compensation filter to compensate for the frequency characteristics which vary when a distance between a speaker and a floor is 1 m.

FIG. 6C illustrates frequency characteristics of an audio frequency characteristic compensation filter obtained by combining the down firing frequency characteristic compensation filter illustrated in FIG. 6A and the spatial frequency compensation filter illustrated in FIG. 6B.

Referring to FIGS. 6A through 6C, the audio frequency characteristics of the audio frequency characteristic compensation filter of an AV apparatus, which are illustrated in FIG. 6C, may be obtained by combining the down firing frequency characteristic compensation filter to compensate for the frequency characteristics of the high band signal, which are illustrated in FIG. 6A, and the spatial frequency compensation filter to compensate for the frequency characteristics varying in accordance with a mounting space, which are illustrated in FIG. 6B.

Also, a dip component generated by a comb filter is compensated for in accordance with a sound-absorbing material of the floor.

Figures 7A, 7B, 7C, 7D:
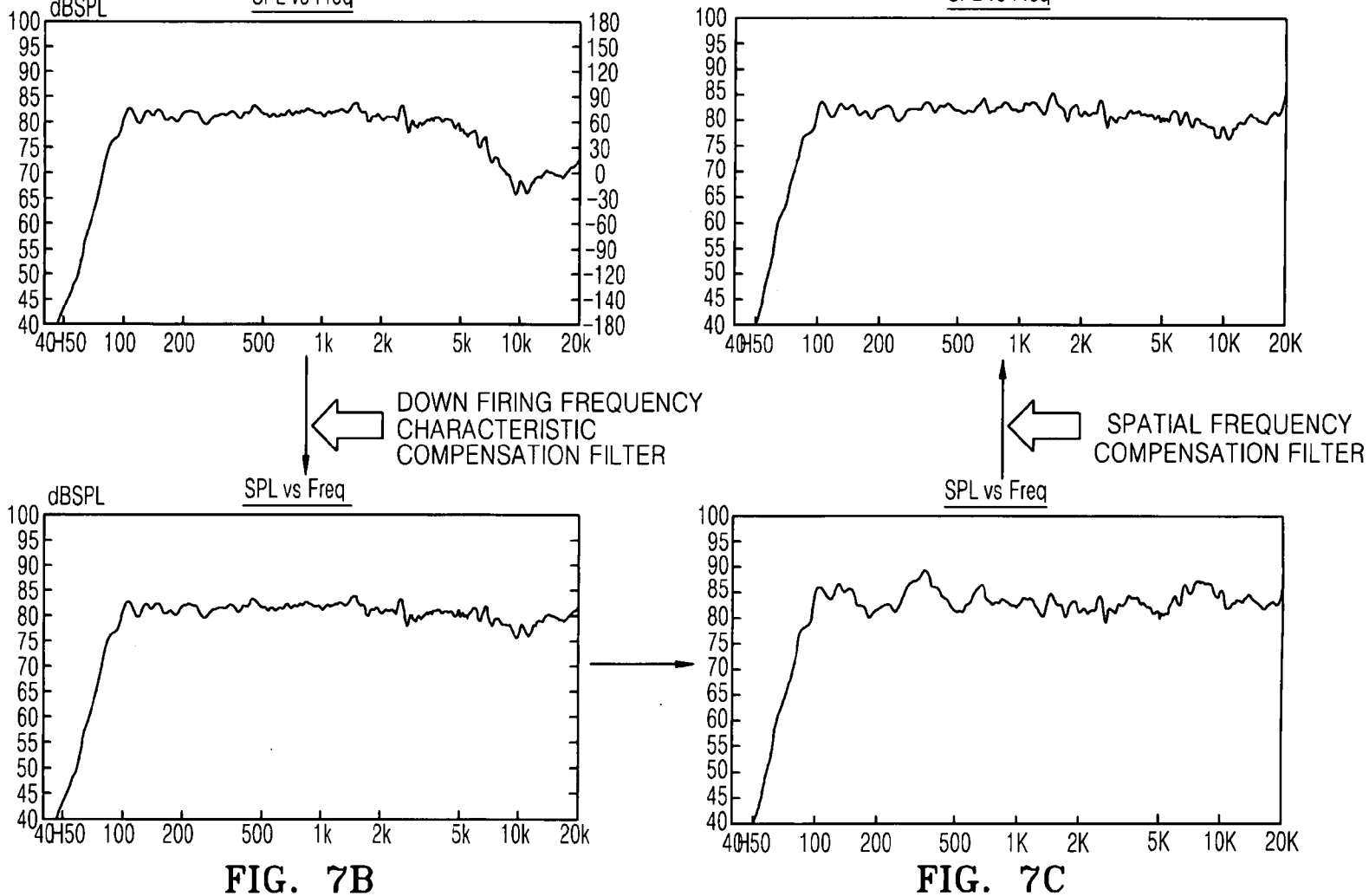
FIGS. 7A through 7D are graphs illustrating a case when distortion of frequency characteristics of a down firing speaker that is tuned in an anechoic room is compensated for by using a down firing frequency characteristic compensation filter and a spatial frequency compensation filter, according to an embodiment of the present general inventive concept.

FIGS. 7A through 7B are graphs illustrating a case when distortion of frequency characteristics of a down firing speaker that is tuned in an anechoic room is compensated for by using a down firing frequency characteristic compensation filter and a spatial frequency compensation filter, according to an embodiment of the present general inventive concept.

FIG. 7A illustrates frequency characteristics of the down firing speaker that is tuned in the anechoic room.

FIG. 7B illustrates frequency characteristics of the down firing speaker which is tuned in the anechoic room in which a high band is compensated for by using the down firing frequency characteristic compensation filter illustrated in FIG. 6A.

FIG. 7C illustrates frequency characteristics of the down firing speaker in which the high band is compensated for and which is mounted at a height of 1 m from a floor.

FIG. 7D illustrates frequency characteristics of the down firing speaker that is mounted at the height of 1 m from the floor and in which variations of the frequency characteristics are compensated for by using the audio frequency characteristic compensation filter, audio frequency characteristics of which are illustrated in FIG. 6C.

As described above, according to various embodiments of the present general inventive concept, sound quality of a conventional hidden speaker may be improved by using a down firing speaker apparatus and a high band compensation filter. Also, frequency characteristics of left and right channel down firing speakers may be automatically compensated for by selecting proper down firing frequency characteristic compensation filters and spatial frequency compensation filters in accordance with distance information measured by ultrasonic sensors.

Furthermore, frequency characteristics of left and right channel down firing speakers may be automatically compensated for by selecting proper down firing frequency characteristic compensation filters and spatial frequency compensation filters in accordance with a mounting condition input by a user through a UI.

The general inventive concept can also be implemented as computer-readable codes on a computer-readable recording medium. The computer-readable medium can include a computer-readable recording medium and a computer-readable transmission medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

While the present general inventive concept has been particularly illustrated and described with reference to exemplary embodiments thereof, it will be understood by those of ordinary skill in the art that varies in form and details may be made therein without departing from the spirit and scope of the general inventive concept as defined by the appended claims. The exemplary embodiments should be considered in a descriptive sense only and not for purposes of limitation. Therefore, the scope of the general inventive concept is defined not by the detailed description of the general inventive concept but by the appended claims, and all differences within the scope will be construed as being included in the present general inventive concept.

What is claimed is:

1. A method of compensating for audio frequency characteristics of an audio/video (AV) apparatus, the method comprising:

calculating a listening distance between the AV apparatus and a listener;

calculating a distance between a speaker mounted on the AV apparatus and a neighboring reflective surface;

selecting a spatial frequency compensation filter value and a speaker frequency characteristic compensation filter value in accordance with the calculated distances; and compensating for frequency characteristics of an audio signal by selectively combining the spatial frequency compensation filter value and the speaker frequency characteristic compensation filter value in accordance with the calculated distances, wherein a setting of the spatial frequency compensation filter value and the speaker frequency characteristic compensation filter value comprises:

if a difference between the distance between a left channel speaker and the neighboring reflective surface thereof and the distance between a right channel speaker and the neighboring reflective surface thereof is larger than a predetermined threshold value, the spatial frequency compensation filter value and the speaker frequency characteristic compensation filter value being set differently with respect from one to another in accordance with channels and the calculated distances; and if the difference between the distance between the left channel speaker and the neighboring reflective surface thereof and the distance between the right channel speaker and the neighboring reflective surface thereof is equal to or smaller than the predetermined threshold value, the spatial frequency compensation filter value and the speaker frequency characteristic compensation filter value being commonly set with respect from one to another in accordance with the calculated distances.

2. The method of claim 1, wherein the speaker has a down firing structure, and is mounted on a lower portion of the AV apparatus, and a diaphragm of the speaker faces downward.

3. The method of claim 1, wherein the calculating of the distance between the speaker mounted on the AV apparatus and the neighboring reflective surface comprises:

calculating the distance between each channel speaker mounted on the AV apparatus and a neighboring wall or floor.

4. The method of claim 1, wherein the calculating of the distance between the speaker mounted on the AV apparatus and the neighboring reflective surface comprises:

calculating the distance between each channel speaker mounted on the AV apparatus and the neighboring reflective surface by using ultrasonic waves.

5. The method of claim 1, wherein each of the distances is calculated based on distance information that is input by the user through a user interface (UI).

6. The method of claim 1, wherein the spatial frequency compensation filter value and the speaker frequency characteristic compensation filter value are respectively selected from spatial frequency compensation filter values which are preset in accordance with distances and speaker frequency characteristic compensation filter values which are set in default.

7. The method of claim 1, wherein the speaker frequency characteristic compensation filter value compensates a high band that is damped when the speaker is down-fired.

8. The method of claim 1, wherein the spatial frequency compensation filter value compensates for frequency characteristics which vary in accordance with a mounting condition of the speaker having a down firing structure.

9. An audio/video (AV) apparatus, comprising:

channel speaker units to output audio signals;

a control unit to extract information on a listening distance between the AV apparatus and a listener, and information on a distance between each of the channel speaker units and a respective neighboring reflective surface thereof, and to select a spatial frequency compensation filter and a speaker frequency characteristic compensation filter of each of the channel speaker units, in accordance with the extracted information; and an audio frequency compensation unit to compensate for frequency characteristics of an audio signal by selectively combining the spatial frequency compensation filter and the speaker frequency characteristic compensation filter which are set by the control unit in accordance with the extracted information, wherein a setting of a spatial frequency compensation filter value and a speaker frequency characteristic compensation filter value comprises:

if a difference between the distance between a left channel speaker and the neighboring reflective surface thereof and the distance between a right channel speaker and the respective neighboring reflective surface thereof is larger than a predetermined threshold value, the spatial frequency compensation filter value and the speaker frequency characteristic compensation filter value being set differently with respect from one to another in accordance with channels and the calculated distances; and if the difference between the distance between the left channel speaker and the neighboring reflective surface thereof and the distance between the right channel speaker and the neighboring reflective surface thereof is equal to or smaller than the predetermined threshold value, the spatial frequency compensation filter value and the speaker frequency characteristic compensation filter value being commonly set with respect from one to another in accordance with the calculated distances.

10. The AV apparatus of claim 9, wherein the channel speaker units are mounted on the AV apparatus or a wall mount speaker apparatus, and are disposed at a predetermined angle off-axis position from the listener so as not to be seen from a front side of the AV apparatus.

11. The AV apparatus of claim 9, further comprising:

a storage unit to store spatial frequency compensation filter values which are preset in accordance with distances and speaker frequency characteristic compensation filter values which are set in default.

12. The AV apparatus of claim 9, wherein the speaker frequency characteristic compensation filter compensates a high band that is damped when each of the channel speaker units is down-fired.

13. The AV apparatus of claim 9, wherein the spatial frequency compensation filter compensates for frequency characteristics which vary in accordance with a mounting condition of each of the channel speaker units having a down firing structure.

14. The AV apparatus of claim 9, wherein each of the spatial frequency compensation filter and the speaker frequency characteristic compensation filter is a finite impulse response (FIR) filter or an infinite impulse response (IIR) filter.

15. The AV apparatus of claim 9, further comprising:

a user interface (UI) through which distance information is exchanged between the AV apparatus and a user, wherein the UI inputs the information on the listening distance between the AV apparatus and the listener, and the distance between each of the channel speaker units and a neighboring reflective surface thereof, which are defined by the user, to the AV apparatus.

16. A computer readable recording medium having embodied thereon a computer program to execute a method, wherein the method comprises:

calculating a listening distance between an audio/video (AV) apparatus and a listener;

calculating a distance between a speaker mounted on the AV apparatus and a neighboring reflective surface;

selecting a spatial frequency compensation filter value and a speaker frequency characteristic compensation filter value in accordance with the calculated distances; and compensating for frequency characteristics of an audio signal by selectively combining the spatial frequency compensation filter value and the speaker frequency characteristic compensation filter value in accordance with the calculated distances, wherein a setting of the spatial frequency compensation filter value and the speaker frequency characteristic compensation filter value comprises:

if a difference between the distance between a left channel speaker and the neighboring reflective surface thereof and the distance between a right channel speaker and the neighboring reflective surface thereof is larger than a predetermined threshold value the spatial frequency compensation filter value and the speaker frequency characteristic compensation filter value being set differently with respect from one to another in accordance with channels and the calculated distances; and if the difference between the distance between the left channel speaker and the neighboring reflective surface thereof and the distance between the right channel speaker and the neighboring reflective surface thereof is equal to or smaller than the predetermined threshold value, the spatial frequency compensation filter value and the speaker frequency characteristic compensation filter value being commonly set with respect from one to another in accordance with the calculated distances.

17. An audio/video (AV) apparatus, comprising:

a channel speaker unit including one or more of a spatial frequency compensation filter and a speaker frequency characteristic compensation filter, the channel speaker unit having a down-firing structure to radiate sound downward along a firing axis that extends at a predetermined angle off-axis position from a listener; and a control unit to extract information on a listening distance between the AV apparatus and the listener, and a surface distance between the channel speaker unit and a neighboring reflective surface thereof, the extracted information of the listening distance and the surface distance being based on the firing axis, wherein the control unit sets, based on the extracted information, the one or more of the spatial frequency compensation filter to compensate for frequency characteristics which vary in accordance with a mounting condition of the channel speaker unit and a speaker frequency characteristic compensation filter to compensate for a high band based on the extracted information, wherein a setting of a spatial frequency compensation filter value and a speaker frequency characteristic compensation filter value comprises:

if a difference between the surface distance between a left channel speaker and the neighboring reflective surface thereof and the surface distance between a right channel speaker and the neighboring reflective surface thereof is larger than a predetermined threshold value, the spatial frequency compensation filter value and the speaker frequency characteristic compensation filter value being set differently with respect from one to another in accordance with channels and the extracted information;

if the difference between the surface distance between the left channel speaker and the neighboring reflective surface thereof and the surface distance between the right channel speaker and the neighboring reflective surface thereof is equal to or smaller than the predetermined threshold value, the spatial frequency compensation filter value and the speaker frequency characteristic compensation filter value being commonly set with respect from one to another in accordance with the extracted information.

18. The AV apparatus of claim 17, wherein the predetermined angle is substantially 90 degrees.

19. The AV apparatus of claim 18, wherein the channel speaker unit is disposed at the predetermined angle off-axis position from a listener to prevent the listener from viewing the channel speaker unit from a front side of the AV apparatus.

20. A method of operating an audio/video (AV) apparatus, the method comprising:

extracting, by using a control unit, information on a listening distance between an AV apparatus and a listener, and a surface distance between a channel speaker unit having a down-firing structure that radiates sound along a firing axis that extends at a predetermined angle off-axis position from the listener and a neighboring reflective surface thereof, the extracted information of each of the listening distance and the surface distance based on a firing axis, and setting, based on the extracted information, one or more of a spatial frequency compensation filter to compensate for frequency characteristics which vary in accordance with a mounting condition of the channel speaker unit and a speaker frequency characteristic compensation filter to compensate for a high band based on the extracted information, wherein a setting of a spatial frequency compensation filter value and a speaker frequency characteristic compensation filter value comprises:

if a difference between the surface distance between a left channel speaker and the neighboring reflective surface thereof and the surface distance between a right channel speaker and the neighboring reflective surface thereof is larger than a predetermined threshold value, the spatial frequency compensation filter value and the speaker frequency characteristic compensation filter value being set differently with respect from one to another in accordance with channels and the extracted information; and if the difference between the surface distance between the left channel speaker and the neighboring reflective surface thereof and the surface distance between the right channel speaker and the neighboring reflective surface thereof is equal to or smaller than the predetermined threshold value, the spatial frequency compensation filter value and the speaker frequency characteristic compensation filter value being commonly set with respect from one to another in accordance with the extracted information.

* * * * *